United States Patent [19]

Bascou

[11] Patent Number: 4,468,941

[45] Date of Patent: Sep. 4, 1984

[54] ELECTRIC LOCKING DEVICE, PARTICULARLY FOR AN AUTOMOBILE HOOD

[75] Inventor: Jacques Bascou, Boulogne Billancourt, France

[73] Assignee: Regie Nationale des Usines Renault, Boulogne-Billancourt, France

[21] Appl. No.: 352,267

[22] Filed: Feb. 25, 1982

[30] Foreign Application Priority Data

Mar. 10, 1981 [FR] France ..... 81 04705

[51] Int. Cl.[3] ..... E05B 65/12; E05C 3/06

[52] U.S. Cl. ..... 70/241; 292/201

[58] Field of Search ..... 70/240, 241; 292/201, 292/240, 210

[56] References Cited

U.S. PATENT DOCUMENTS

| | | | |
|---|---|---|---|
| 2,896,990 | 7/1959 | Garvey | 292/201 |
| 2,898,138 | 8/1959 | Van Noord | 292/122 |
| 2,943,880 | 7/1960 | Joachim | 292/201 |
| 3,378,291 | 4/1968 | Brian | 292/68 |
| 3,384,405 | 5/1968 | Schiele | 292/201 |
| 3,835,678 | 9/1974 | Meyer | 70/241 |

*Primary Examiner*—Robert L. Wolfe

*Attorney, Agent, or Firm*—Oblon, Fisher, Spivak, McClelland & Maier

[57] ABSTRACT

Electric locks of the armed type comprise a movable bolt assembly actuated by various levers, powered by a motorized reduction gear assembly and capable of hooking a keeper mounted on a stationary part of the body. The bolt assembly comprises a locking lever of a keeper and a blocking lever of the locking lever, both biased in the hooked position by a common spring. A rotating control body controls the preceding levers, and rotates successively in the opening direction and in the reverse closing direction while being powered by a motorized reduction assembly in response to the impulses of electric current.

6 Claims, 10 Drawing Figures

ELECTRIC LOCKING DEVICE, PARTICULARLY FOR AN AUTOMOBILE HOOD

BACKGROUND OF THE INVENTION

1. Field of the Invention

The present invention relates to an electric locking device, particularly for a hood or a trunk lid on an automobile, utilizing an electric lock of the armed type comprising a moving bolt assembly actuated by a motor-driven reduction gear assembly which can hook a keeper mounted on a stationary part of the body.

2. Description of the Prior Art

The operations of opening and closing the hood generally require more or less forceful manipulating. Thus, it is desirable to avoid manual operations as much as possible by replacing them with controlled mechanisms without resorting to overly costly or complicated solutions.

In order to close the hood, a lock mechanism is necessary. Usually, this phase of operation turns out to be the most laborious because it entails the application of a significant force to overcome the momentary resistance due to the total engagement of the lock and due to the compression of the sealing joints, which usually accompany the hood's snapping shut.

SUMMARY OF THE INVENTION

The object of the invention is to create an automatic hood locking and unlocking device that provides an easy approach and a gentle presentation of the locking elements until the first catch of the lock is engaged, without having to apply heavy force as mentioned.

With the closing and locking functions being motorized, it becomes possible to maintain a slight over-balance over the entire hood which would also make completely automatic opening of the hood after unlocking possible.

To this end the object of the invention is to create an electric locking device of the type described above, in which the bolt assembly comprises a spring-equipped keeper locking lever and a lever which blocks the locking lever in the hooked position. A rotating body which controls said lever is set into successive rotations in the opening direction and in the opposite closing direction by a motorized reduction gear assembly in response to impulses of electric current.

In addition, the rotating control body can pivot around an axis perpendicular to its rotation axis. Retraction of the control body is by torsion spring, either by the action of the locking lever coming in contact with an inclined ramp on the control body, or by the action of an exterior opening lever. This provides manual control of the lock by releasing and blocking the locking lever in case of electrical malfunction.

BRIEF DESCRIPTION OF THE DRAWINGS

Various other objects, features and attendant advantages of the present invention will be fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
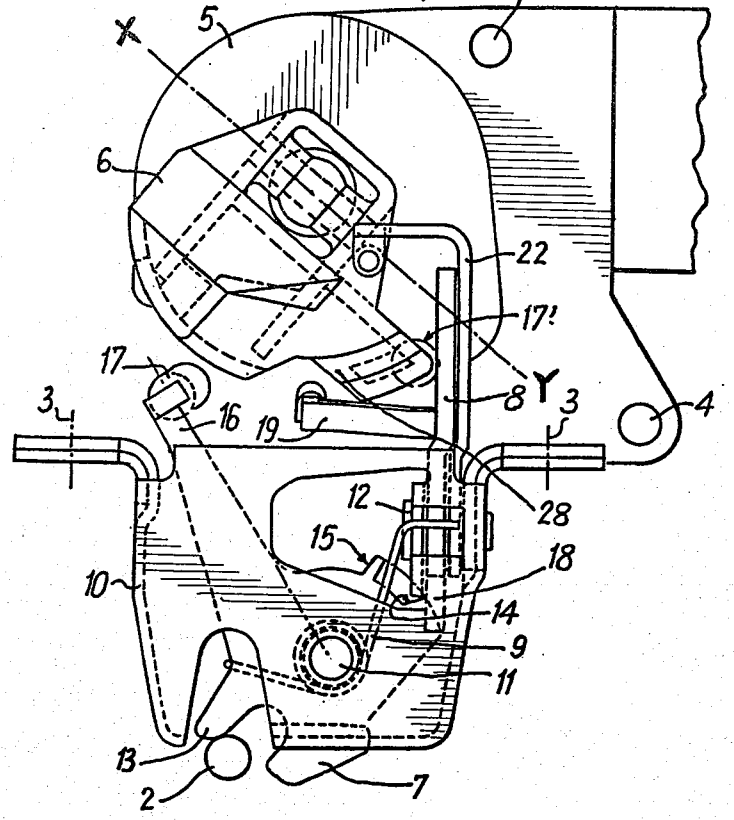

In the illustrated embodiment, the motorized assembly 1 is mounted on a movable panel, hood or trunk lid, while the keeper 2, in the shape of a stirrup, is mounted to a stationary part of the body. FIG. 1 schematically shows several points 3 and 4 where the attachment is by classic assembly means.

The electric lock comprises a motorized reduction gear assembly 5 whose output shaft sequentially activates a lock lever 7 of the keeper and a blocking lever 8 for the locking lever, by means of a rotating control body 6. These two levers are biased in the opening position of FIG. 1 by a common torsion spring 9 fastened between said levers.

The locking lever 7 and the blocking lever 8 pivot perpendicularly in relation to each other around their respective axes 11 and 12 inside a housing 10 of bent sheet metal. The common return spring 9 is wound around axis 11 of the locking lever.

The locking lever 7 has a projection in the form of a hook 13 which fits around the keeper 2, a zone of diametrically opposed notchings, provided with two successive blocking notches 14 and 15 and a curved arm 16 ending in a roller 17 that is positionable for interacting with certain surfaces on the rotating control body 6 in order to pivot the locking lever 7 selectively in the keeper locking or unlocking direction.

The blocking lever 8 has a protrusion 18 which can engage through the biasing force of a spring 9, in one of the notches on the locking lever depending on the position of the latter, a curved arm 19 which can interact at its end with certain cams on the rotating control body 6 and an arm 20 which is acted on by an exterior manual control button 21 in order to pivot the blocking lever 8 in the unblocking direction, i.e. away from its blocking position of the locking lever 7 in order to free the latter for opening.

The rotating control body 6, moved successively in two rotation directions by the output of the motorized reduction gear assembly 5, is a single piece made preferably of molded synthetic material. Its form is compact but it has very irregular contours, i.e. there is a variety of bearing faces and cams with various shapes which control the respective movements of the abovementioned levers which constitute the movable elements of the bolt assembly. The different characteristic shapes of the control body 6 will be described hereinafter along with the operation of the device.

Figure 9:
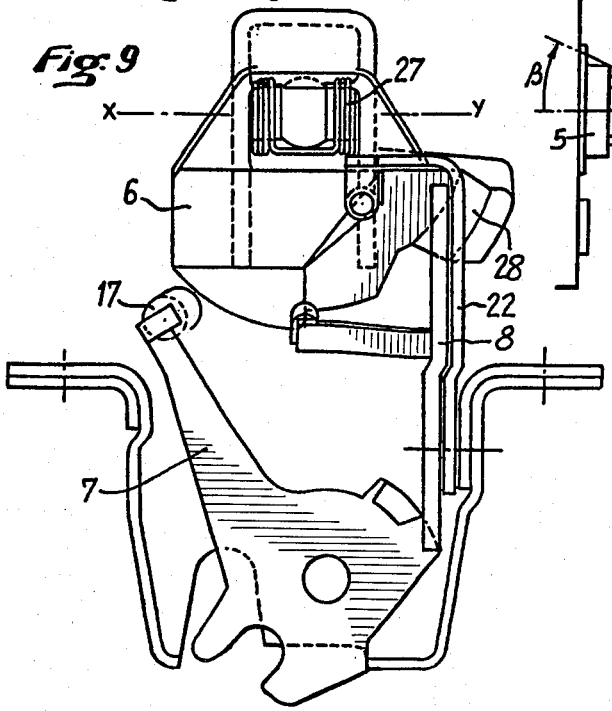
FIGS. 9 and 10 illustrate exterior manual unblocking of the lock in the event of electrical malfunction.
Figure 10:
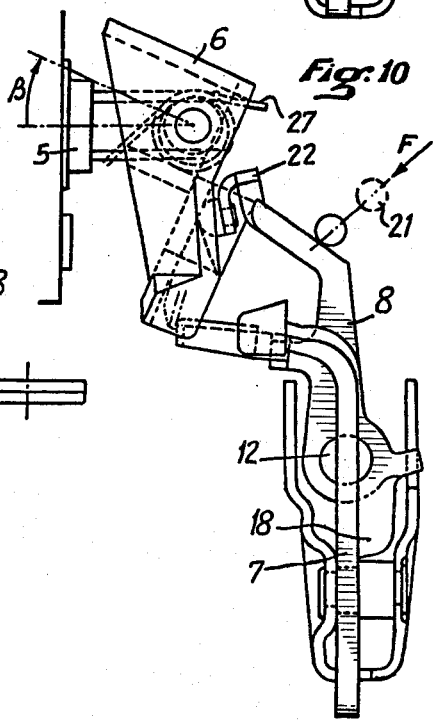

In addition to its rotation around the motor axis, the control body can also pivot around an XY axis, e.g. in the event of an electrical malfunction, unlocking can be achieved through manual action from an exterior button 21 (FIGS. 9 and 10) whose force is relayed to the control body 6 by way of a manual opening lever 22 pivotally mounted around the axis of articulation 12 of the blocking lever 8 and pivoting parallel to the latter.

The device according to the invention operates in the following manner:

1. Automatic Hood Closing

Figure 2:
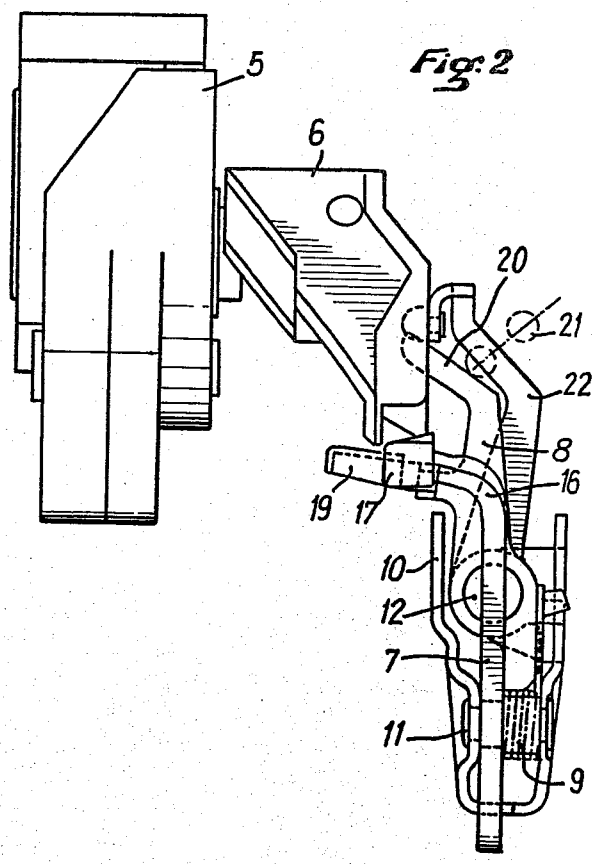
FIGS. 1 and 2 show, in elevation and in side view, the locking device according to the invention in open position.
Figure 3:
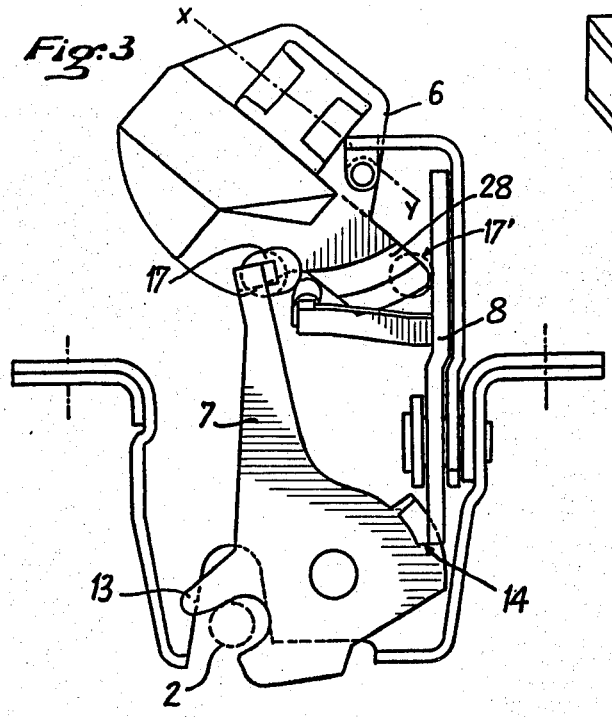
FIGS. 3 and 4 illustrate the hooked position of the lock at the first notch of the lock lever before motorized rotation of the control body.

Beginning in the open position (FIGS. 1, 2) the manual reclosing of the hood introduces the keeper 2 in the hook 13 of the locking lever. The resulting rotation of the locking lever 7 permits the blocking lever 8 to pivot (clockwise) to the first blocking notch 14 (FIG. 3).

Figure 4:
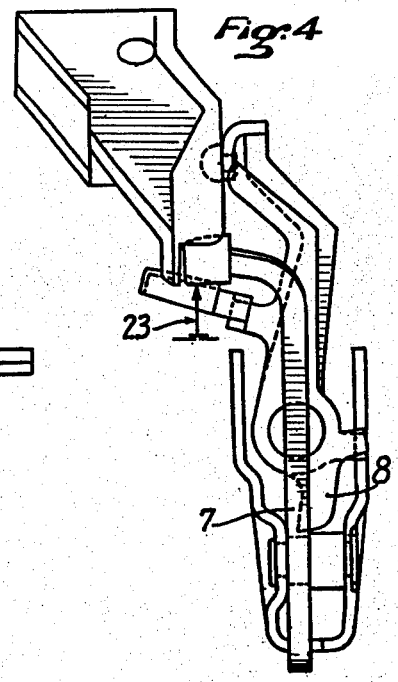

Simultaneously, as a result of the rotation of the locking lever 7, the extremity of the arm 16 of the locking lever makes electrical contact by means of a switch 23 (FIG. 4), so as to energize the motorized reduction gear assembly 5 and cause the control body 6 to rotate (counterclockwise).

Figure 7:
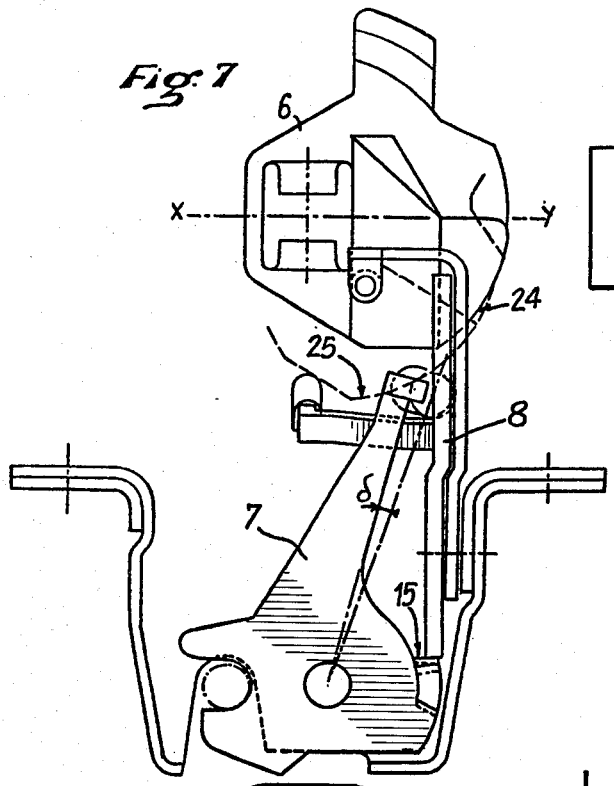
FIGS. 7 and 8 illustrate complete closing of the lock at the second notch of the locking lever, after complete rotation of the control body.

After a rotation of "α" (FIG. 5), the bearing face "f" of the control body makes contact with the roller 17 on the locking lever and causes the latter to pivot (clockwise) until the blocking lever is in the second blocking notch 15 (FIG. 7). At that point the keeper is completely locked, but the control body 6 continues its course to the position shown in FIG. 7. The locking and blocking levers are equipped with a common return spring 9.

2. Automatic Hood Opening

This phase is accomplished by the reverse rotation (clockwise) of the control body caused by remote control electrical opening impulse coming either from a switch (not shown) inside the vehicle compartment or from an exterior switch activated by a trunk key or by a push button, for example.

To unblock the lock in order to open it, it is necessary to anticipate the particular kinematics of the locking lever 7 and blocking lever 8 in order to assure their progressive disengagement and then their automatic release under the force of the spring 9.

Due to the rotation of the control body 6 (clockwise starting in the position in FIG. 7) the exterior profile of the cam 24 first causes the locking lever 7 to travel through an angle "δ" (clockwise), corresponding to the position of the control body illustrated with a broken line 25 in FIG. 7. This action breaks the contact between the locking lever and the blocking lever 8 which is in contact with the second blocking notch 15.

Continuing its rotation (FIG. 5), the cam 24 of the control body 6 causes the blocking lever 8 to move in counterclockwise direction (FIG. 6) through contact with the curved arm 19 of the blocking lever so as to prevent subsequent engagement of the blocking lever 8 with the notches 14 and 15 as the spring 9 returns the locking lever to the portion of FIG. 1.

Figure 5:
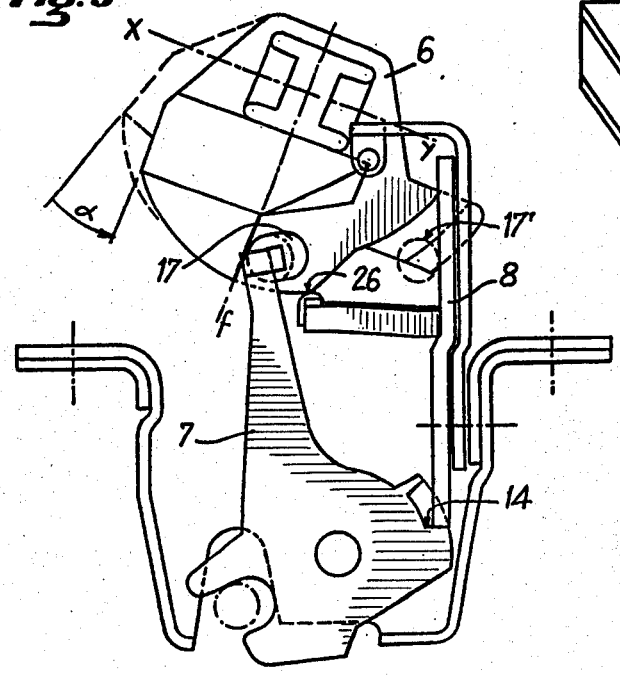
FIGS. 5 and 6 illustrate the approach position of the rotating control body.
Figure 6:
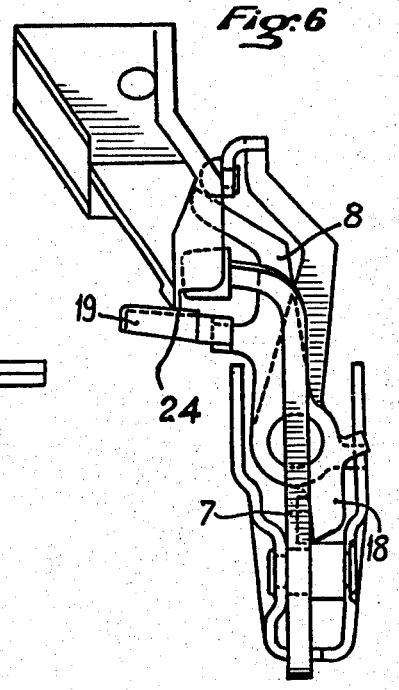

Continuing its rotation from FIG. 5 to FIG. 1, the variation in the profile of the cam 24 returns the blocking lever 8 from engagement with the cam at point 26 to its relaxed position while the free locking lever 7 is pushed by the spring 9 into the open position shown in FIG. 1.

3. Manual Closing and Opening of the Hood

In the event that there is an electrical malfunction, the device is designed to operate manually regardless of the position of the control body 6 at the moment of malfunction.

If the control body is in the position in FIG. 7, it does not impede the pivoting movements of the locking lever 7 and blocking lever 8. The hood is closed simply by pushing on the latter until the blocking lever engages the second notch 15 of the locking lever.

Figure 8:
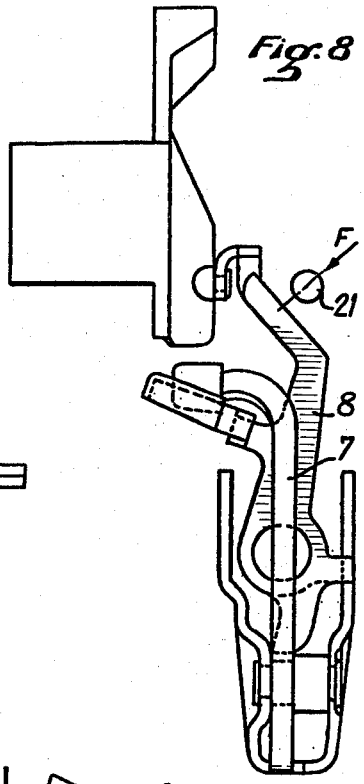

To open the hood, a mechanical action in the direction F (FIG. 8) exerted from the outside on the blocking lever 8 by way of a push-button 21 frees levers 7 and 8 and releases the lock.

If the control body 6 is in an intermediate position other than the locked position in FIG. 7, it presents an impediment to the pivoting of the lever described previously. This impediment is eliminated by pivoting the control body through an angle "β" (clockwise, FIG. 10) around its axis XY, compressing a torsion spring 27 wound around its articulation.

Pivoting the control body is done differently depending on whether the lock is closed or open.

When manually closing the hood, causing the locking lever to pivot to permit engagement of the blocking lever with the second blocking notch 15, the roller 17 on the lever 7 meets in its trajectory an inclined ramp 28 forming an integral part of the control body 6. One component of the exerted force pivots the control body in a direction about the XY axis. The roller 17 on the locking lever occupies the positions 17′ shown with a broken line in FIGS. 1, 3 and 5.

When opening, the exterior push button 21 (FIG. 10) acts simultaneously on the opening lever 22 and the blocking lever 8 to pivot the control body 6 on the one hand and to release the blocking 8 and locking levers 7, on the other.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electric locking device for a vehicle closure, said locking device comprising:

a keeper mounted on a first portion of said vehicle;

a movable bolt assembly mounted on a second portion of said vehicle, said second portion being movable relative to said first portion;

a motorized reversible reduction gear assembly mounted on said bolt assembly and including a rotatable shaft;

a control body mounted on said rotatable gear assembly shaft, said control body being mounted for pivoting about an axis perpendicular to said shaft;

a locking lever pivotally mounted on said bolt assembly, including a first portion engageable with said control body for moving said locking lever into a first position in engagement with said keeper;

a blocking lever pivotally mounted on said bolt assembly, said blocking lever including a first portion engageable, in a first position thereof, with said locking lever in said first position thereof for blocking movement of said locking lever from said first position thereof, and a second portion engageable with said control body for moving said blocking lever out of said first position thereof; and first spring means biasing said locking lever out of said first position thereof and biasing said blocking lever into said first position thereof.

2. The device of claim 1, said device including:

an opening lever movable into engagement with said control body;

second spring means biasing said control body into a first position about said axis wherein said control body is engageable with said locking and blocking lever; and manually operated means movable into engagement with said opening and blocking levers for moving said blocking lever away from said first position thereof and for moving said control body away from said first position thereof.

3. The device of claim 2 wherein said opening and blocking levers pivot about a common axis.

4. The device of claim 1 wherein said locking lever includes two notches, and wherein said engagement of said blocking lever with said locking lever is at said notches.

5. The device of claim 1 wherein said control body includes cam portions which engage said locking and blocking levers.

6. The device of claim 1 including a switch engageable by said locking lever for actuating said control body in a first direction, and including circuitry for actuating said control body in a second direction.

* * * * *